United States Patent [19]

Rappen

[11] Patent Number: 4,767,024

[45] Date of Patent: Aug. 30, 1988

[54] BLOWING DEVICE FOR ELIMINATION OF COMPACTIONS IN BULK MATERIAL STORAGE SILOS

[75] Inventor: Albert Rappen, Mülheim/Ruhr, Fed. Rep. of Germany

[73] Assignee: VSR Engineering GmbH Fördertechnik, Fed. Rep. of Germany

[21] Appl. No.: 5,758

[22] Filed: Jan. 21, 1987

[30] Foreign Application Priority Data

Jan. 25, 1986 [DE] Fed. Rep. of Germany ..... 3602207

[51] Int. Cl.[4] ..... B67B 7/24

[52] U.S. Cl. ..... 222/3; 222/195; 285/179

[58] Field of Search ..... 222/3, 195, 4, 386, 222/400.7; 285/179, 150, 153, 127; 280/735, 736, 741, 742, 737

[56] References Cited

U.S. PATENT DOCUMENTS

| | | | |
|---|---|---|---|
| 1,226,427 | 5/1917 | White | 285/150 |
| 1,272,794 | 7/1918 | Girtanner | 285/179 |
| 2,587,170 | 2/1952 | Klingler et al. | 285/179 |
| 3,942,684 | 3/1976 | Stetson | 222/195 |
| 4,021,058 | 5/1977 | Suzuki et al. | 222/3 |
| 4,387,914 | 6/1983 | Paulson et al. | 285/179 |
| 4,676,402 | 6/1987 | Stetson | 222/3 |

*Primary Examiner*—Joseph J. Rolla
*Assistant Examiner*—Kenneth Noland
*Attorney, Agent, or Firm*—McGlew & Tuttle

[57] ABSTRACT

A blowing device for the elimination of compactions in bulk material storage silos by using air blasts, includes a compressed air storage container, a compressed air supply duct, a compressed air outflow duct and an interposed rapid exit valve. The rapid exit valve has a conduit in which a valve closure is guided whereby the conduit turns into the compressed air supply duct forming an afflux cross-section for the valve piston over a miter cut or tube turn. The afflux cross-section is selected to be significantly greater than the outflow cross-section in the compressed air outflow duct. In this way, the flow losses, and pressure losses, otherwise customary are considerably reduced, so that extremely high flow velocities can be achieved in the compressed air outflow duct until the velocity of sound is reached. The result is a rapid impulse-like discharge of the compressed air storage container and, consequently, faultless elimination of possible compactions.

9 Claims, 3 Drawing Sheets

BLOWING DEVICE FOR ELIMINATION OF COMPACTIONS IN BULK MATERIAL STORAGE SILOS

FIELD AND BACKGROUND OF THE DISCLOSURE

This invention relates in general to bulk material handling devices and in particular to a new and useful blowing device for eliminating compactions in storage silos for bulk materials.

The invention concerns a blowing device which uses air blasts for the elimination of compactions in bulk material storage silos with a compressed air storage container, with a compressed air supply duct connected to the compressed air storage container, a compressed air outflow duct, a rapid exit valve interposed between the compressed air supply duct and the compressed air outflow duct and with a compressed air inlet pipe socket with a multiway valve connected to the rapid exit valve whereby in the rapid exit valve between open position and closed position a directly air pressure actuated valve closure is guided and in a closed position, is pressed against the compressed air outflow duct and is fashioned as a valve seat.

A blowing device is known of a kind in which the compressed air supply duct, the compressed air outflow duct and the rapid exit valve and its housing presents a construction unit. In this construction unit the compressed air supply duct and the compressed air outflow duct are arranged orthogonally to each in such a way that during afflux of the rapid exit valve considerable flow and throttle losses occur. The same is true of the form and guidance of the valve closure which is practically fashioned as a valve disk with an inside and an outside collar. In a closed position the valve disk contacts, with the inside collar, the valve seat of the compressed air outflow duct at the end side while the outside collar is intended to guide the valve disk in the valve housing. This guiding, however, is already somewhat problematic if for no other reason than between the outside collar and the inner wall of the valve housing, sufficient margin clearance must be given to allow motion so that the compressed air storage container can be supplied with compressed air through the compressed air inlet pipe socket connected to the valve housing with the rapid exit valve in closed position. An annular channel between the outside collar of the valve disk and the guiding surface on the inside wall of the valve housing practically serves this purpose. The resulting motion can lead to flutter effects or tilting in the case of valve disks and consequently to reduce flow velocities in the compressed air outflow duct and to greatly slowed or completely missing opening processes such that an impulse-like discharge of the compressed air storage container is frequently hardly achieved. However, air blasts then remain to a large extent ineffective. In this respect the invention proposes a solution.

SUMMARY OF THE INVENTION

The invention provides a blowing device which uses air blasts for the elimination of compactions in bulk material storage silos having optimal flow conditions as well as a capacity to work with great burst impulses and permits ease of assembly.

According to the invention, a class appropriate blowing device includes a rapid exit valve which has a conduit between the valve seat and the compressed air inlet pipe socket, and a valve closure fashioned as a valve piston which is guided in the conduit. The conduit turns has a miter cut or tube turn into the compressed air supply duct forming an outflow cross section of a given size for the valve piston and the afflux cross section is selected to be considerably greater than the outflow cross section in the compressed air outflow duct. A preferred embodiment of the invention shows the outflow cross section twice as large as the cross section of the conduit and its cross section at least twice as large as the outflow cross section in the compressed air outflow duct. In the blowing device according to the invention, the outflow cross section is blown against without any great flow or throttle losses after sufficient release of the valve seat and the outflow duct diameter by the valve piston whereby the highest flow velocity occurs only in the outflow cross section and in the compressed air outflow duct and may reach the velocity of sound. This leads to a rapid impulse-like discharge of the compressed air storage container to a compressed air blast leaving the compressed air outflow duct with a considerable shock wave which is particularly advantageous for the removal of the bulk material. The valve piston can be fashioned as a spring-loaded trunk piston having a frontal area which is much greater than the outflow duct diameter. In this way, strong impact impulses can be created. Minimal flow or throttle losses are given, especially if the conduit turns into the compressed air supply duct as an arc-shaped tube turn or the other way around.

Further characteristics essential to the invention are listed below.

According to a preferred embodiment of the invention, the center line of the compressed air supply duct lies in the plane of the valve seat of the corresponding duct end of the compressed air outflow duct and the compressed air outflow duct and the conduit with coaxial center lines are arranged orthogonally to the compressed air supply duct. In this way, it can be achieved that the afflux cross section is very much larger than the outflow cross section and the end of the compressed air outflow duct which forms the valve seat does not hinder effective flow. According to another embodiment, the invention teaches that the compressed air outflow duct is fashioned as a tube turn, for instance 90° tube turn, and proceeds from the plane of the valve seat from the rapid exit valve. In this case also, flow and throttle losses, are kept to a minimum. This is especially the case when the center lines of the compressed air supply duct and of the arc-shaped compressed outflow duct in the region of the outflow and are arranged coaxially. The center line of the compressed air supply duct can likewise lie in the plane of the valve seat of the arch-shaped compressed air outflow duct.

According to another modified embodiment, the invention provides that the compressed air supply duct and the conduit are arranged with coaxial center lines to each other and that the compressed air outflow duct proceeds from the plane of the valve seat as a tube turn, for example as 90° tube turn. In every case, a design enhancing flow in the region of the afflux cross section and outflow cross section is achieved. In accordance with the invention the rapid exit valve in the ground transition region from compressed air supply duct and conduit can have an expansion opposite the duct end of the compressed air outflow duct which forms the valve seat in order to maintain in this region also a decrease of the flow resistance and acceptable expansion losses.

The blowing device is especially easy to assemble according to the invention when the rapid exit valve has a valve housing with an inflow chamber and pipe threads for the connection of the compressed air supply duct, the compressed air outflow duct and, if necessary, for the conduit. In line with its practical and functional design, the inflow chamber has a mounting opening for a pressure and/or path sensor, preferably in the region of the piston area to achieve control for the piston position. In addition, in this way control of the fill time, possible leakages, the compressed air supply and the emptying process can be accomplished. Furthermore, the inflow chamber can have an inlet and an outlet opening for the compressed air storage container. Finally, for reasons of assembly techniques, the compressed air supply duct can be connected rapidly to a container socket of the compressed air storage container via clamp coupling and the compressed air outflow duct can be connected with clamp coupling to the outflow conduit.

The advantages obtained through the invention are essentially that a blowing device using air blasts for the elimination of compactions in bulk material storage silos has been created which shows optimal flow characteristics so that in the compressed air outflow duct, extremely high flow velocities are achieved and finally the velocity of sound is reached resulting in a rapid impulse-like discharge of the compressed air storage container. Beyond that, the blowing device according to the invention can be assembled quickly and easily.

Accordingly, it is an object of the invention to provide a blowing device for the elimination of compactions in bulk material in a storage silo using air blasts which comprises a compressed air storage container having a supply duct connected to a compressed air outlet duct which is adapted to be connected to the storage silo and having a rapid exit valve in the connection between the storage container supply duct and the outflow duct with a valve closure member movable therein toward and away from the outflow storage duct for closing and opening the duct and with the valve conduit and the outflow duct and the supply duct forming an afflux cross section for the rapid exit valve which has a turn for a miter which is made with a cross section which is substantially greater than the cross section of the outflow duct.

A further object of the invention is to provide an improved device for dislodging compactions in storage containers of bulk material and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
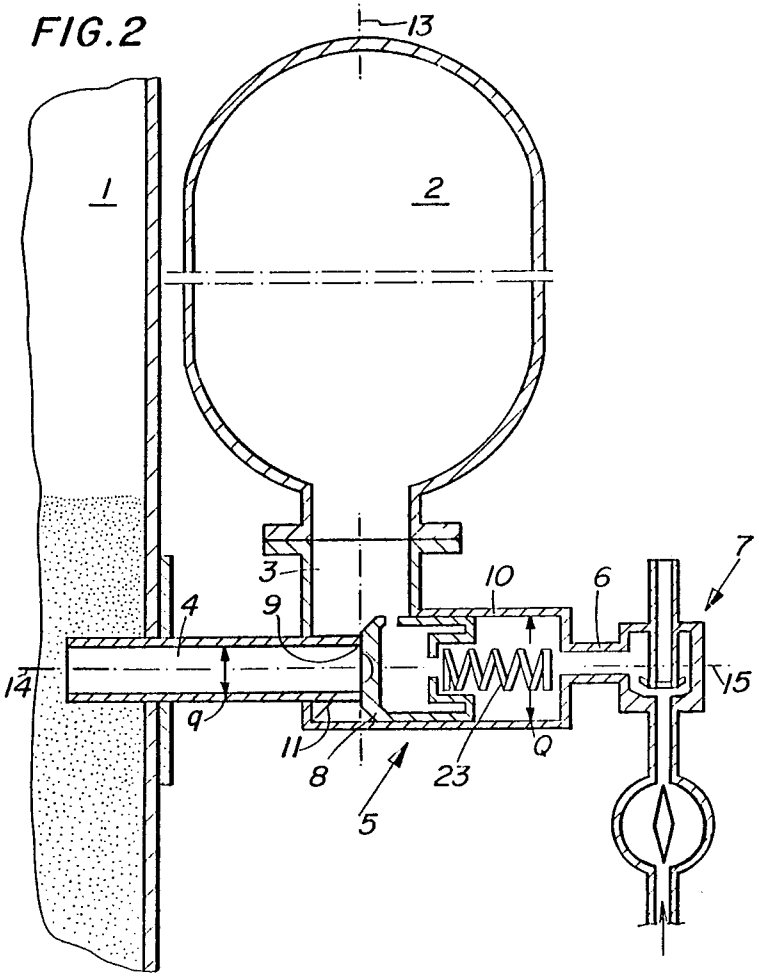
FIG. 2 is a view similar to FIG. 1 but after completed compressed air loading.
Figure 1:
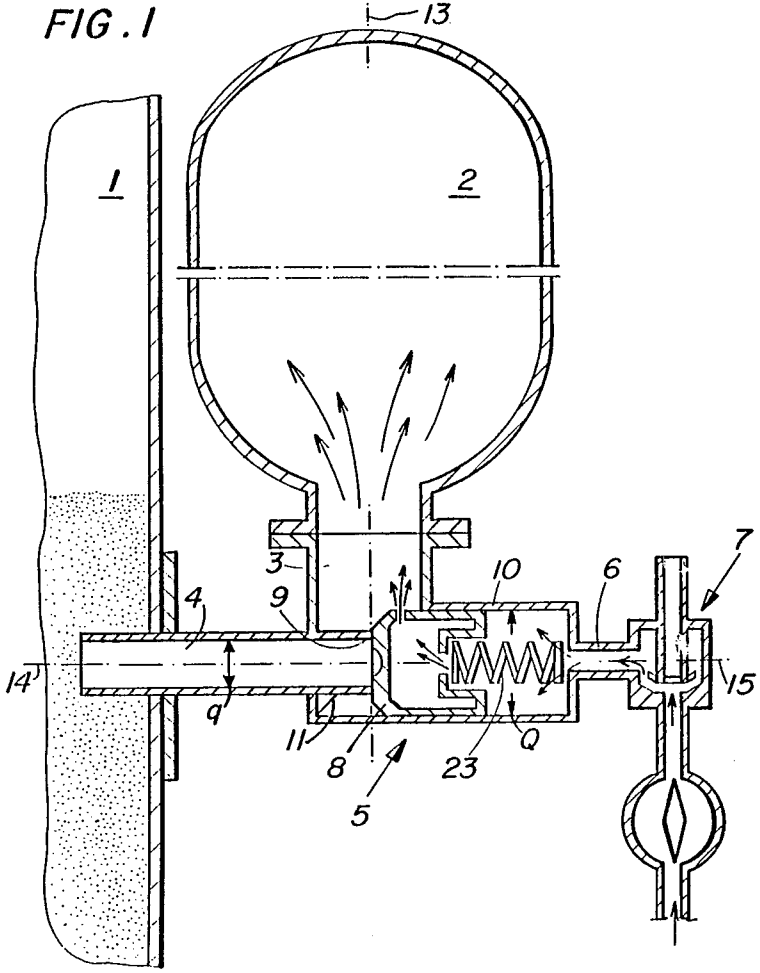
FIG. 1 is a sectional view of a blowing device according to the invention represented schematically and in particular when it is at the beginning of compressed air loading.
Figure 3:
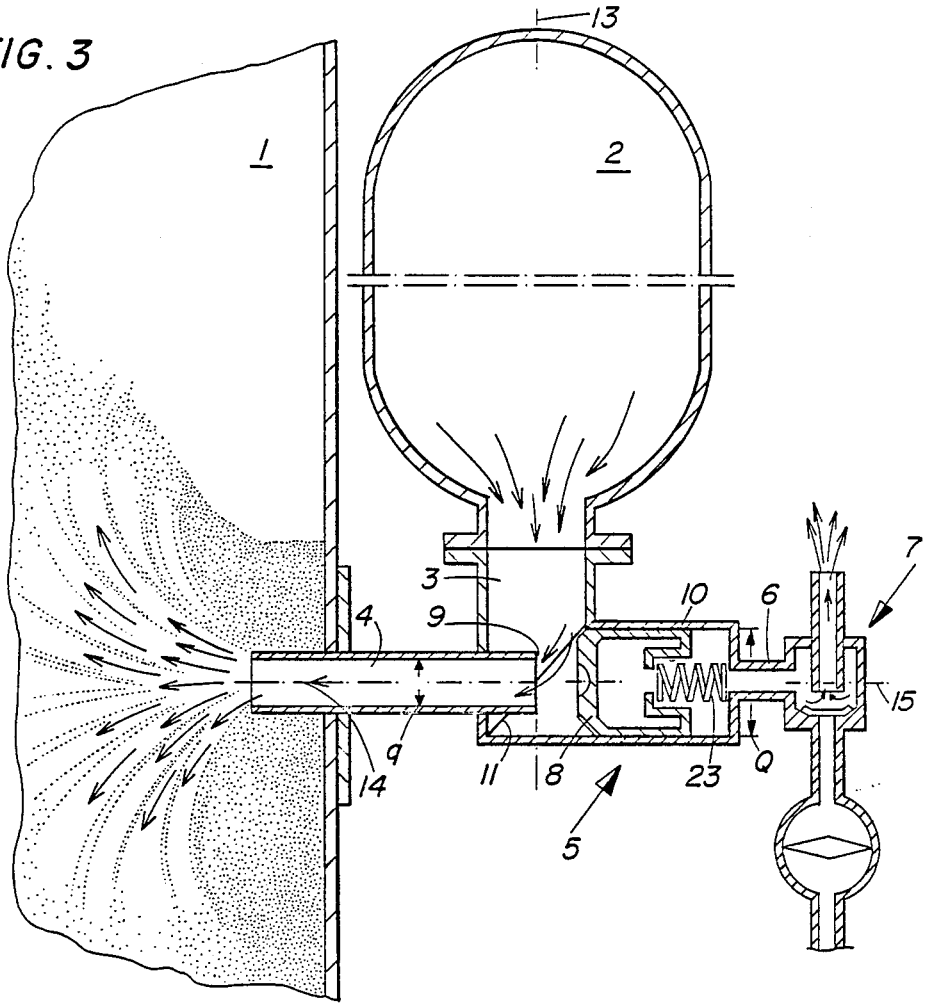
FIG. 3 is a view similar to FIG. 1 but in the process of compressed air discharge.

Referring to the drawings in particular the invention embodied therein comprises a blowing device for the elimination of compaction in bulk material storage silos 1 which includes a compressed air storage container 2 having a supply duct 3 which is connected to a compressed air outflow duct 4 which is connected to the storage silo 1 and also connected to the supply duct 3. In accordance with the invention a rapid exit valve 5 is in the connection between supply duct 3 and the outlet duct 4 and it includes a valve conduit, a valve closure member movable in the conduit. The valve closure member 5 is movable toward and away from the outflow duct 4 for closing and opening this duct. In accordance with the invention, the valve conduit 10, the outflow duct 4, and the supply duct 3 form an afflux cross section for the valve closure member which has a turn and which has a cross section which is substantially greater than the cross section of the outflow duct.

Figure 4:
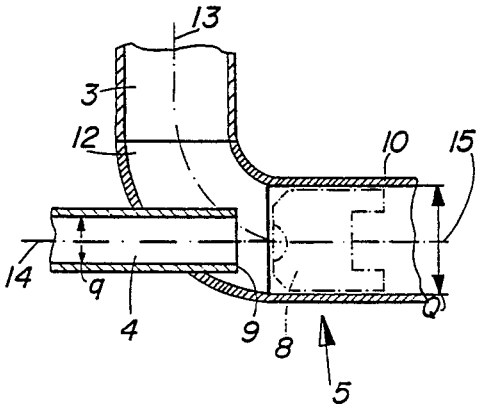
FIGS. 4 to 9 are partial sectional views of modified embodiments of blowing devices.
Figure 5:
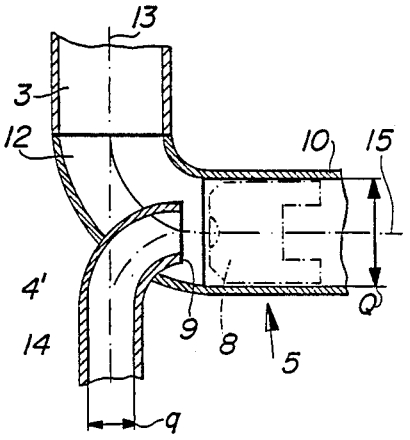

The illustrations show a blowing device using air blasts for the elimination of compactions in bulk material storage silos 1, in particular with a compressed air storage container 2. A compressed air supply duct 3 is connected to the compressed air storage container 2. A rapid exit valve 5 is interposed between the compressed air supply duct 3 and a compressed air outflow duct 4. A compressed air inlet pipe socket 6 is connected with a multiway valve 7 at one end and is connected to the rapid exit valve 5 on the opposite end or inlet side. In the rapid exit valve 5 a directly air pressure actuated valve closure or valve piston 8 is guided for movement between an open and a closed position. In the closed position the valve piston 5 is pressed against the end of the compressed air outflow duct 4 fashioned as a valve seat 9. The rapid exit valve 5 includes a conduit 10 between the valve seat 9 and the compressed air inlet pipe socket. The valve closure is fashioned as valve piston 8 and guided in the conduit 10. The conduit 10 has a turn extending into the compressed air supply duct 3 forming an afflux cross section Q of a given size for the valve piston 8. The conduit 10 includes either a miter cut 11 or tube turn 12 (FIGS. 4 and 5) and an afflux cross section Q which is selected to be greater than the outflow cross section q in the compressed air outflow duct 4. In the embodiment according to illustration 1, the center line 13 of the compressed air supply duct 3 lies in the plane of the valve seat 9 and the center lines of the conduit 10 and of the compressed air outflow duct 4. The compressed air outflow duct 4 and the conduit 10 are arranged with coaxial center lines 14 and 15 or orthogonally to the compressed air supply duct 3. According to FIG. 4, the conduit 10 turns into the compressed air supply duct 3 in an arc-shaped tube 12.

Figure 7:
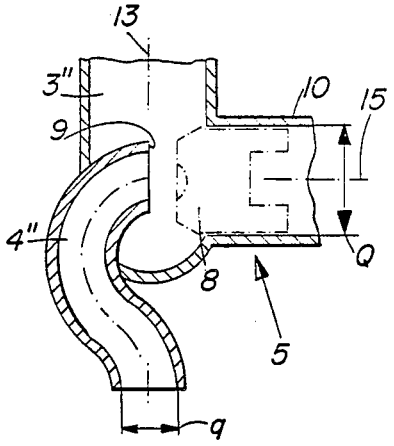

In the embodiment according to illustrations 5 and 7, the compressed air outflow duct 4 is fashioned as tube turn 12, for example 90° tube turn, and proceeds from the rapid exit valve from the plane of the valve seat 9. The center lines 13, 14 of the compressed air supply duct 3 and of an arc-shaped compressed air outflow duct 4' can thereby be arranged coaxially in the region of the outflow end as has been indicated in illustration 5. In the embodiment according to FIG. 7, the center line 13 of the compressed air supply duct 3' lies, in addition, in the plane of the valve seat 9 of the compressed arc-shaped air outflow duct 4". In the embodiment according to illustration 7, the compressed air supply duct 3" and the conduit 10 are arranged with center lines 13, and 15 perpendicular to each other, whereby the compressed air outflow duct 4 proceeds as tube turn, for example as 90° tube turn, from the plane of the valve seat.

Figure 6:
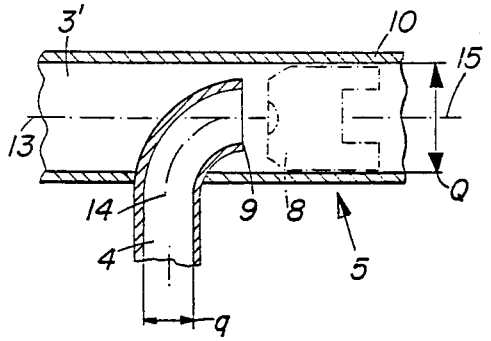
Figure 8:
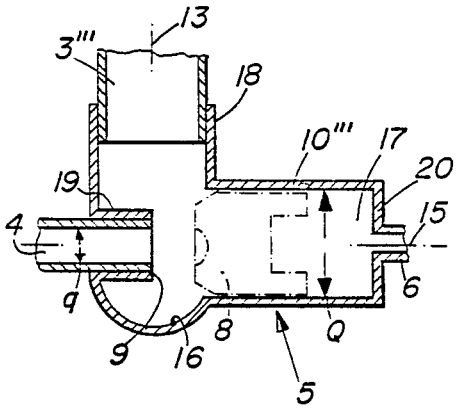
Figure 9:
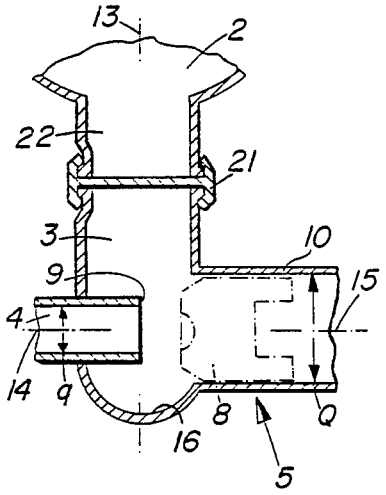

In the embodiments according to FIGS. 8 and 9, the rapid exit valve 5 shows in the ground transition region from the compressed air supply duct 3'" and the conduit 10'" an expansion 16 opposite the duct end of the compressed air outflow duct 4 which forms the valve seat. According to FIG. 6, the rapid exit valve 5 can have a valve housing with an inflow chamber 17 and pipe threads 18 and 19 for connections of the compressed air supply duct 3 and the compressed air outflow duct 4. In this case, the conduit 10 is an integral part of the rapid exit valve 5 and is adjacent to the inflow chamber 17. The inflow chamber 17 has a mounting opening 20 for a piston path or position sensor, preferentially in the region of the piston edge area. In addition, the inflow chamber can have an inlet and an outlet opening for the compressed air storage container which is not shown. Finally, the compressed air supply duct 3 can be connected quickly with a clamp coupling 21 to a container socket 22 of the compressed air storage container 2.

The Figures show readily that in order to load the compressed air storage container 2 the multiway valve 7 has to be set to "in" because in this way, the compressed air storage container 2 through the conduit 10, the rapid exit valve 5, and the compressed air supply duct 3 is connected to the compressed air system. The compressed air storage container 2 is filled with compressed air to pressure compensation so that the blowing device is operational. In the process of discharge, the multiway valve 7 is pressure released through the changing of the setting of the multiway valve 7 to a "Ventilation" setting.

As a consequence of the excess pressure in a compressed air storage container a valve piston is pushed back into an open position against the action of a pressure spring so that the compressed air can stream through a compressed air supply duct through a rapid exit valve and into a compressed air outflow duct into a bulk material container to expand and bring about the desired loosening of the compacted bulk material. After this discharge a valve piston is moved by the pressure spring again into the closed position so that no foreign gas and/or bulk material can flow from the storage silo into the rapid exit valve and the compressed air storage container.

While specific embodiments of the invention have been shown and described in detail to illustrate the application of the principles of the invention, it will be understood that the invention may be embodied otherwise without departing from such principles.

What is claimed is:

1. A blowing device for elimination of the compactions in bulk material in a storage silo using air blasts, comprising a compressed air storage container having a supply duct, a compressed air outflow duct connected to said storage silo and connected to said supply duct, the connection including a valve conduit having one end connected to said compressed air outflow duct and one end of said compressed outflow duct having an arc-shaped end disposed in said valve conduit, a rapid exit valve in said valve conduit, a valve closure member moveable in said valve conduit toward and away from said outflow duct arc-shaped end and being engageable and disengageable with said arc-shaped end to close and open said outflow duct, and said valve conduit forming an afflux cross-section for said valve closure member having a cross-section which is substantially greater than the cross-section of said air outflow duct and which said valve closure member includes a miter cut, said afflux cross-section being approximately twice as large as the cross-section of said outflow duct, said rapid exit valve including a valve seat which is rounded to enhance flow, said outflow duct forming said valve seat and having said arc-shaped end and said outflow duct having a center line lying in the plane of a center line of said supply duct.

2. A blowing device according to claim 1, wherein said supply duct has a center line lying in the plane of said valve seat and said air outflow duct, said air outflow duct and said conduit having coaxial center lines orthogonally to said compressed air supply duct.

3. A blowing device according to claim 1, wherein said comprssed air outflow duct is formed as a tube turn, for example a 90° tube turn and extends from the plane of said valve seat from said rapid exit valve.

4. A blowing device according to claim 1, wherein said compressed air supply duct has a center line and said air outflow duct has an arc-shaped portion coaxial to said center line.

5. A blowing device according to claim 1, wherein said compressed air supply duct and said conduit are arranged with coaxial center line with respect to each other and said compressed air outflow duct has a tube turn of 90° from said valve seat.

6. A blowing device according to claim 1, wherein said rapid exit valve has an expansion in a ground transition area of said compressed air supply duct in said conduit opposite the duct end of said compressed air outflow duct which forms said valve seat.

7. A blowing device according to claim 1, wherein said rapid exit valve has a valve housing with an inflow chamber, pipe threads in said inflow chamber for connecting the compressed air supply duct and the compressed air outlet duct.

8. A blowing device for elimination of the compactions in bulk material in a storage silo using air blasts, comprising a compressed air storage container having a supply duct, a compressed air outflow duct to be connected to said storage silo and connected to said supply duct, said connection including a valve conduit having one end connected to said compressed air outflow duct, said valve conduit having an opposite end, said supply duct having an arc-shaped end connected to said valve conduit, a rapid exit valve in said valve conduit, a valve closure member moveable in said valve conduit toward and away from an arc-shaped end of said outflow duct and being engageable and disengageable with said arc-shaped end to close and open said outlet duct, said valve conduit forming an afflux cross-section for said valve closure member and having a flow cross-section which is substantially greater than the flow cross-section of said outflow duct; a compressed air inlet pipe connected to said opposite end of said valve conduit, and a multidirectional control valve in said compressed air inlet pipe.

9. A blowing device according to claim 8, wherein said compressed air supply is connected to a container socket of said compressed air storage container and including a clamp coupling at the connection.

* * * * *